US008308123B1

(12) United States Patent
Accordino

(10) Patent No.: US 8,308,123 B1
(45) Date of Patent: Nov. 13, 2012

(54) UMBRELLA MOUNTING SYSTEM

(76) Inventor: Anthony Accordino, Yorba Linda, CA (US)

( * ) Notice: Subject to any disclaimer, the term of this patent is extended or adjusted under 35 U.S.C. 154(b) by 0 days.

(21) Appl. No.: 13/015,378

(22) Filed: Jan. 27, 2011

Related U.S. Application Data

(60) Provisional application No. 61/300,567, filed on Feb. 2, 2010.

(51) Int. Cl.
*F16M 13/00* (2006.01)

(52) U.S. Cl. ... 248/518; 248/156; 248/214; 248/220.21; 248/222.14; 248/228.1; 248/228.5; 248/309.1; 248/511; 248/519; 248/530; 248/534; 248/535

(58) Field of Classification Search ..... 248/518, 248/519, 534, 540, 539, 533, 511, 529, 530, 248/156, 214, 220.21, 222.14, 228.1, 228.5, 248/309.1
See application file for complete search history.

(56) References Cited

U.S. PATENT DOCUMENTS

| | | | | |
|---|---|---|---|---|
| 4,850,564 | A * | 7/1989 | Padin | 248/533 |
| 4,927,117 | A * | 5/1990 | Gainey | 248/539 |
| 6,189,458 | B1 * | 2/2001 | Rivera | 108/44 |
| 6,375,146 | B1 * | 4/2002 | Painchaud | 248/534 |
| 6,953,180 | B1 * | 10/2005 | Ruvalcaba et al. | 248/530 |
| 7,980,616 | B2 * | 7/2011 | Fletcher | 296/64 |
| 8,082,934 | B1 * | 12/2011 | Kucinski | 135/16 |

* cited by examiner

*Primary Examiner* — Amy J Sterling

(57) ABSTRACT

An umbrella mounting system comprises a base having a top surface and a bottom surface, a first side edge and a second side edge; a first base aperture disposed on the base toward the first side edge of the base and a second base aperture disposed on the base toward the second side edge of the base; a cylindrical mounting shaft having a first end with an opening and a second end, the opening of the first end of the mounting shaft functions to hold a shaft of an umbrella that is inserted into the opening, wherein the mounting shaft is attaches the top surface of the base and extends upwardly therefrom.

4 Claims, 7 Drawing Sheets

UMBRELLA MOUNTING SYSTEM

BACKGROUND OF THE INVENTION

Umbrellas are extremely convenient for protection from sun and rain. However, umbrellas are not very stable or easy to manage unless permanently mounted in a ground surface (or table). The present invention features a novel umbrella mounting system for firmly (and temporarily) mounting an umbrella to a table, the like, or a ground surface. The umbrella mounting system provides a firm means of securing an umbrella and will not tip over, even in strong winds. The system can be easily assembled for use and disassembled for storage or transport.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIG. 1-5, the present invention features an umbrella mounting system 100 for firmly mounting an umbrella to a table, the like, or a ground surface. The umbrella mounting system 100 provides a firm means of securing an umbrella and will not tip over, even in strong winds. The system 100 can be easily assembled for use and disassembled for storage or transport. The mounting system 100 may be constructed from a variety of materials, for example from a material comprising steel.

Figure 1:
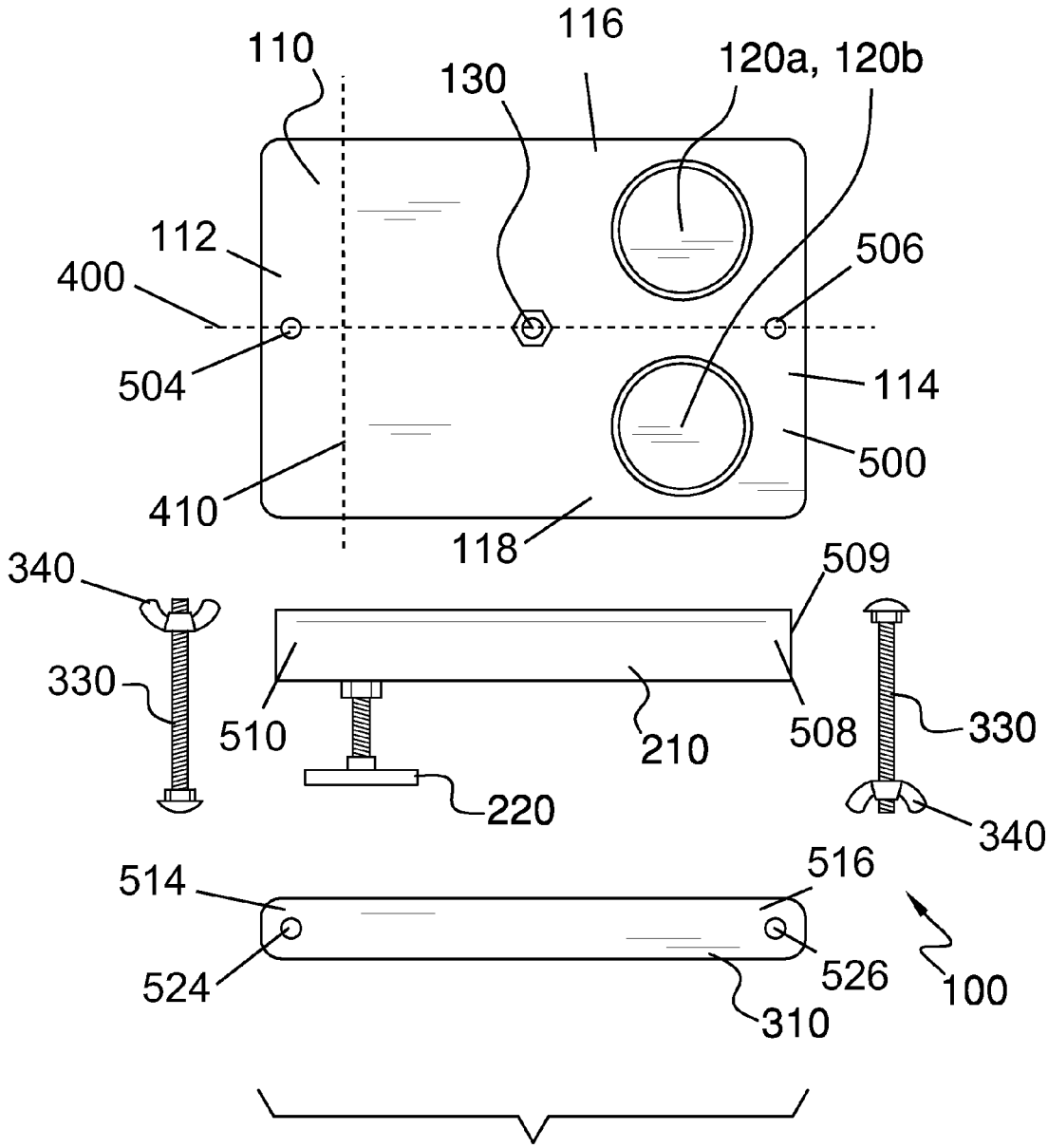
FIG. 1 is top view of the components of the umbrella mounting system of the present invention, wherein the system is disassembled.

As shown in FIG. 1, the umbrella mounting system 100 comprises a base 110. The base 110 may have a first side edge 112, a second side edge 114, a third side edge 116, a fourth side edge 118, a top surface and a bottom surface. Disposed on the top surface of the base 110 are a first cup holder 120*a* and a second cup holder 120*b*. The cup holders 120 can hold cups or other items (see FIG. 5E). The cup holders 120 may be positioned near a side edge of the base 110. Disposed in the base 110, for example in the center of the base 110, is a threaded base bolt 130. In some embodiments, a first base aperture and a second base aperture are disposed in the base 110 on opposite sides (see FIG. 1). A first base aperture 504 is disposed close to the first side edge 112 midway between the third side edge 116 and the fourth side edge 118. A second base aperture 506 is disposed close to the second side edge 114 midway between the third side edge 116 and the fourth side edge 118. The first base aperture 504 and the second base aperture 506 lie on an axis, Axis A 400, that crosses a threaded base bolt 130 on the base 110 top surface 500. An axis, Axis B 410, lies perpendicular to Axis A 400.

The umbrella mounting system 100 further comprises a cylindrical mounting shaft 210 having a first end and a second end. The mounting shaft 210 functions to hold the shaft of an umbrella (e.g., in the open first end). The mounting shaft 210 comprises a tightening mechanism 220, which functions to clamp on the umbrella shaft when placed in the mounting shaft 210. Tightening mechanisms for securing a smaller shaft inside a larger shaft are well known to one of ordinary skill in the art.

The mounting shaft 210 may be constructed in a variety of sizes to accommodate various sized umbrellas. In some embodiments, the mounting shaft 210 can accommodate an umbrella up to about 1.5 inches in diameter. The mounting shaft 210 is not limited to such a dimension. In some embodiments, the shaft 210 is between about 0.5 to 1 inches in diameter. In some embodiments, the shaft 210 is between about 1 to 2 inches in diameter. In some embodiments, the shaft 210 is between about 2 to 4 inches in diameter. In some embodiments, the shaft 210 is more than about 4 inches in diameter.

Figure 2:
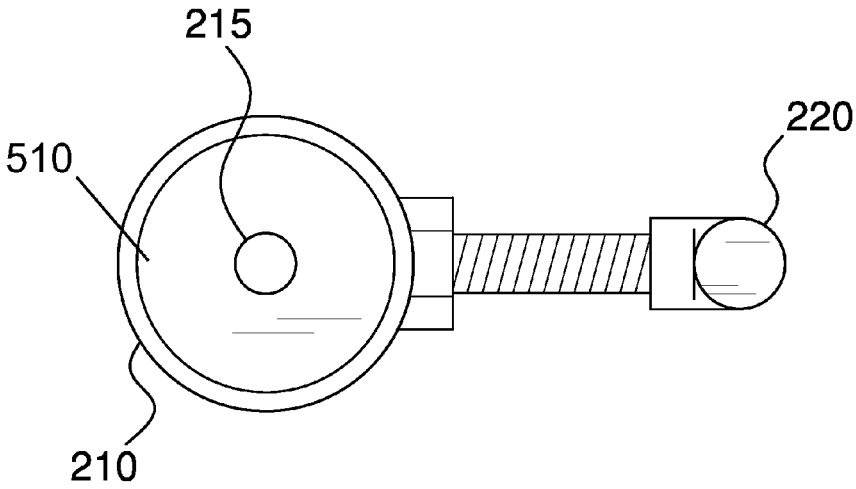
FIG. 2 is a top view of the mounting shaft of the mounting system of the present invention.
Figure 3:
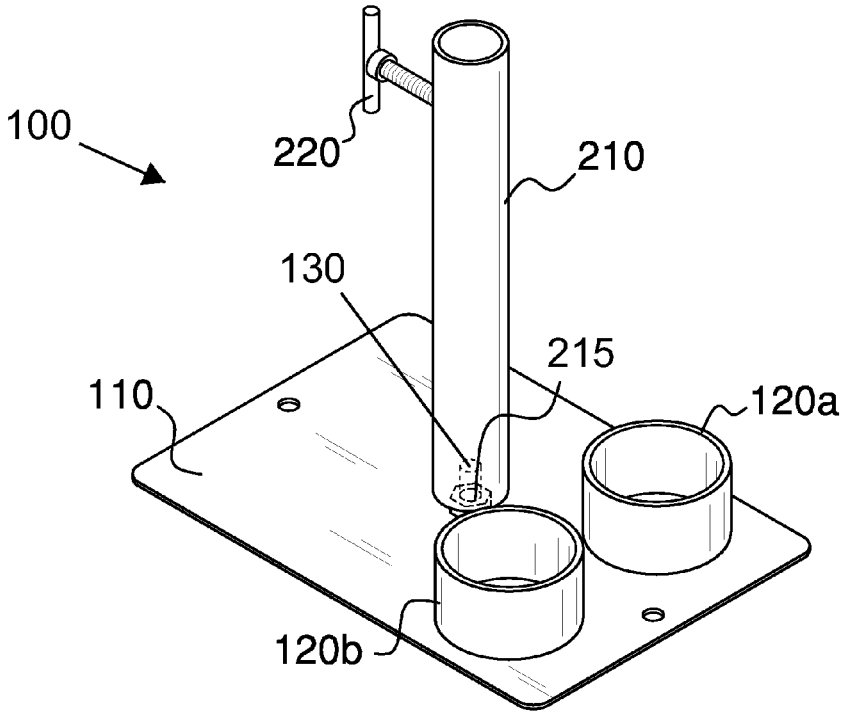
FIG. 3 is a perspective view of the umbrella mounting system of the present invention, wherein the system is assembled.

The mounting shaft 210 is can be secured to the base 110 via the threaded base bolt 130. For example, as shown in FIG. 2, the second end of the mounting shaft 210 is generally closed and comprises a threaded aperture 215 for receiving the threaded base bolt 130. The second end of the mounting shaft 210 can be screwed onto the threaded base bolt 130 to secure the shaft 210 to the base 110. FIG. 3 shows the shaft 210 secured on the base 110 (e.g., generally perpendicularly to the base 110). The present invention is not limited to mounting of the shaft 210 to the base 110 via the threaded base bolt 130.

Figure 4:
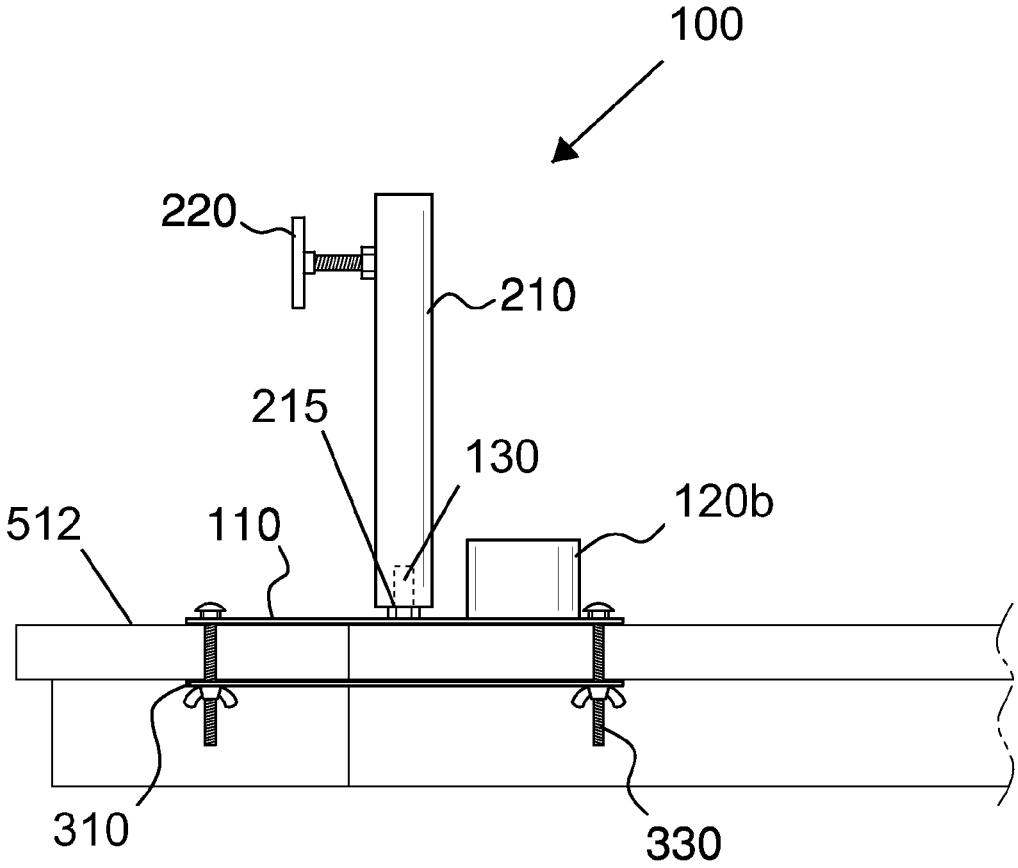
FIG. 4 is a bottom perspective view of the umbrella mounting system of the present invention, wherein the system is mounted on a table.

The mounting system 100 of the present invention further comprises a bottom bracket for mounting the system 100 to a table or the like (see FIG. 4). The bottom bracket 310 may be a generally flat elongated panel having a first end and a second end. A first bracket aperture is disposed in the bottom bracket 310 near the first end and a second bracket aperture is disposed in the bottom bracket 310 near the second end. The bracket apertures are designed to be aligned with the base apertures in the base 110. For example, when the bracket 310 is positioned below the base 110, a first bolt 330 can be driven through the first base aperture and the first bracket aperture, and a second bolt 330 can be driven through the second base aperture and the second bracket aperture (see FIG. 4). The bolts 330 can be secured in place via wing nuts 340.

Figure 5A:
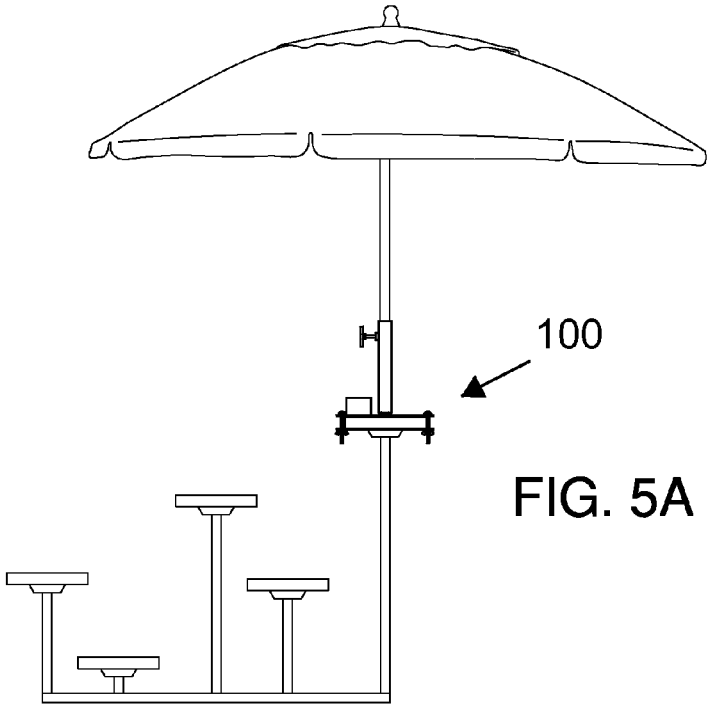
FIGS. 5A-H are in-use views of the umbrella mounting system of the present invention.
Figure 5B:
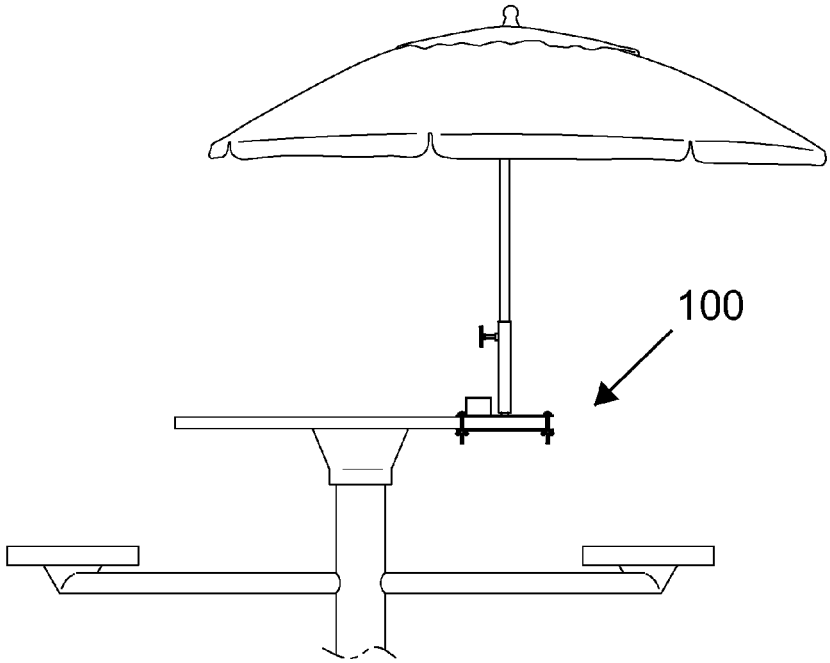
Figure 5C:
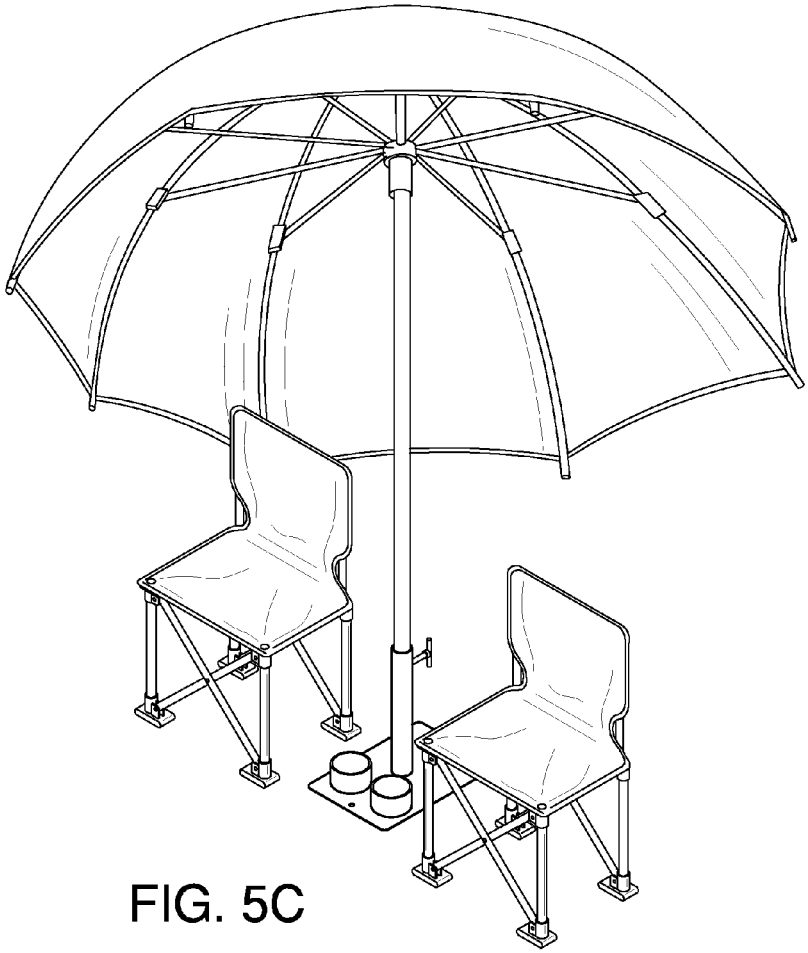

As shown in FIG. 4, a table or other similar surface can be sandwiched between the mounting bracket 310 and the base 110. The bolts 330 and wing nuts 340 can be used to clamp onto the table. This allows secure attachment of the system 100 of the present invention to the table or other similar structure. FIG. 5A and FIG. 5B show the system 100 of the present invention attached to bleachers and a picnic table, respectively.

The bolts 330 may be constructed in a variety of sizes. In some embodiments, the bolts 330 are between about 1 to 2 inches in length. In some embodiments, the bolts 330 are between about 2 to 3 inches in length. In some embodiments, the bolts 330 are more than about 3 inches in length.

In some embodiments, the mounting system 100 of the present invention further comprises one or more stakes. Stakes may alternatively be provided separately. Stakes, like stakes for tents, are well known to one of ordinary skill in the art. The stakes can be used to secure the base 110 on the ground surface (see FIG. 5C, FIG. 5G, and FIG. 5H).

Figure 5D:
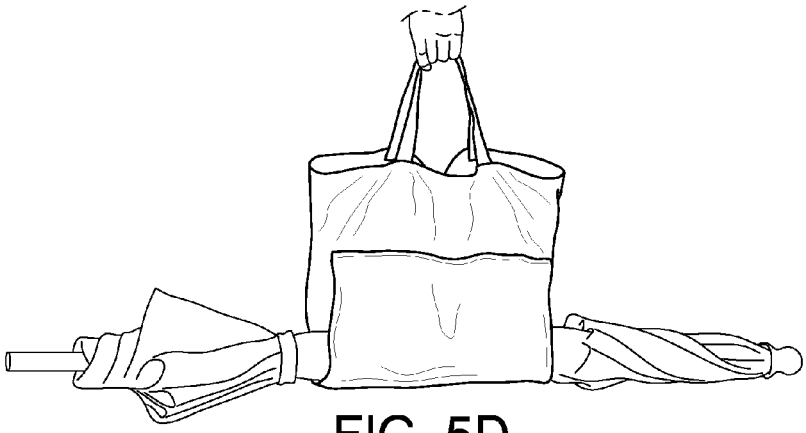
Figure 5E:
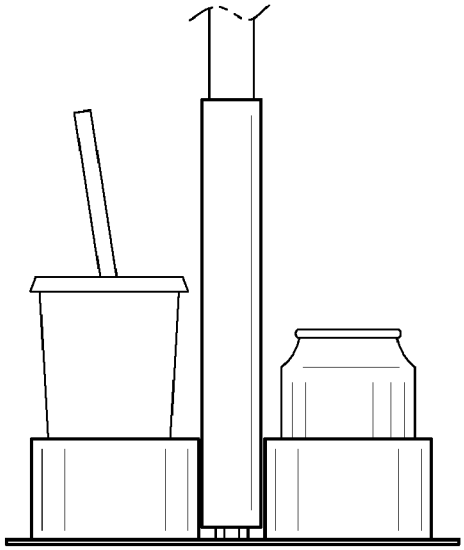
Figure 5F:
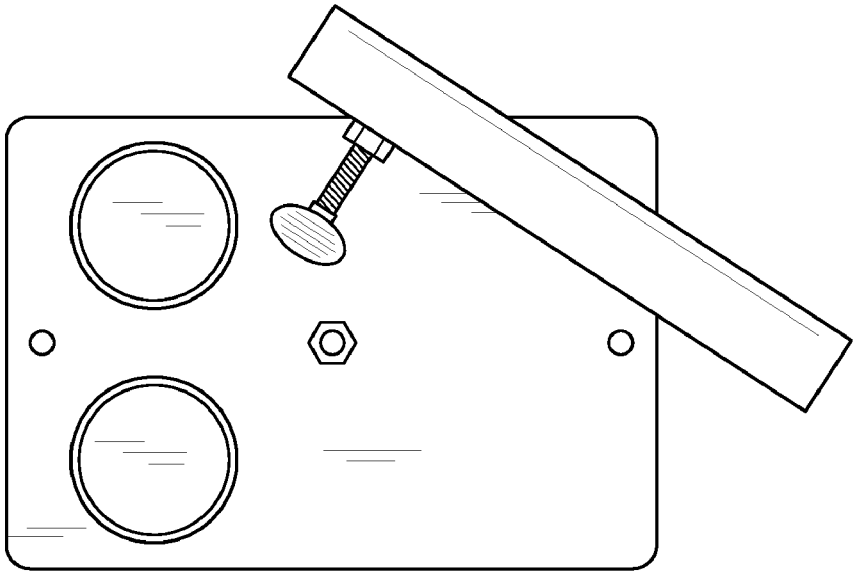
Figure 5G:
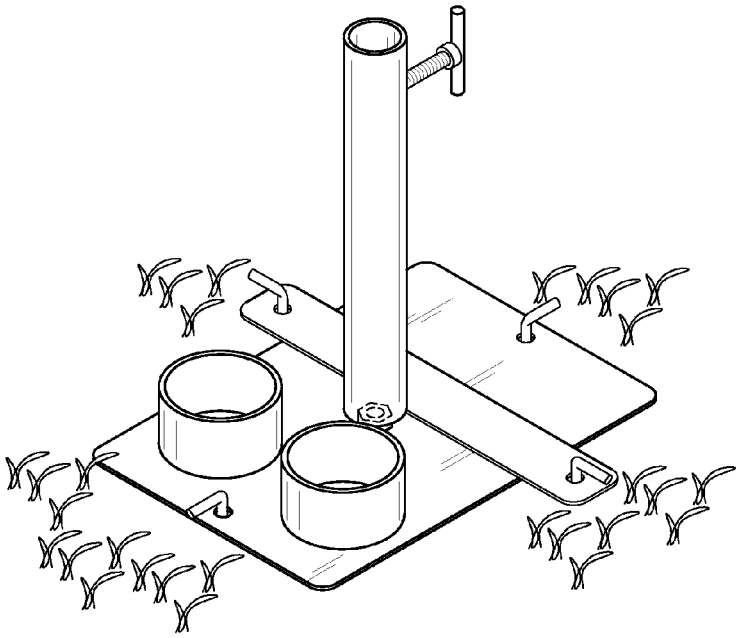
Figure 5H:
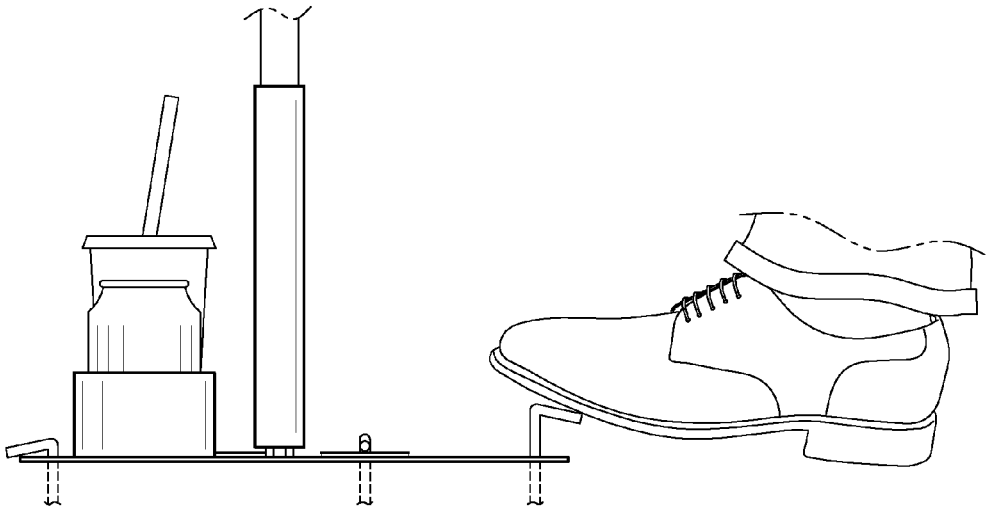

In some embodiments, the mounting system 100 of the present invention further comprises a tote bag (see FIG. 5D). The tote bag may be used for storage or transport of the system 100. In some embodiments, the tote bag comprises a sleeve for the umbrella to be used with the mounting system 100.

In some embodiments, the present invention features an umbrella mounting system 100 comprises a base 110 having a top surface 500 and a bottom surface 502, a first side edge 540 and a second side edge 542; a first base aperture 504 disposed on the base toward the first side edge 540 of the base and a second base aperture 506 disposed on the base toward the second side edge 542 of the base; a cylindrical mounting shaft 210 having a first end 508 with an opening 509 and a second end 510, the opening of the first end of the mounting shaft 210 functions to hold a shaft of an umbrella that is inserted into the opening 509, wherein the mounting shaft 210 is attaches the top surface of the base and extends upwardly therefrom.

As used herein, the term "about" refers to plus or minus 10% of the referenced number. For example, an embodiment wherein the shaft 210 is about 2 inches in diameter includes a shaft 210 that is between 1.8 and 2.2 inches in diameter.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the invention.

What is claimed is:

1. An umbrella mounting system 100 comprising:

(a) a base 110 having a top surface 500 and a bottom surface 502, a first side edge 112, a second side edge 114 opposed to the first side edge 112, a third side edge 116, and a fourth side edge 118 opposed to the third side edge 116, wherein a base length is measured from the first side edge 112 to the second side edge 114, wherein a base width is measured from the third side edge 116 to the fourth side edge 118, wherein the base length is greater that the base width;

(b) a threaded base bolt 130 disposed in the top surface 500 of the base 110;

(c) a first base aperture 504 and a second base aperture 506 disposed in the base 110, wherein the first base aperture 504 is disposed at the first side edge 112 midway between the third side edge 116 and the fourth side edge 118, wherein the second base aperture 506 is disposed at the second side edge 114 midway between the third side edge 116 and the fourth side edge 118, wherein the first base aperture 504 and the second base aperture 506 lie on an axis, Axis A 400, that crosses the threaded base bolt 130 on the base 110 top surface 500;

(d) a cylindrical mounting shaft 210 having a first end 508 with an opening 509 and a second end 510, wherein the opening 509 of the first end 508 of the mounting shaft 210 functions to hold a shaft of an umbrella that is inserted into the opening 509, wherein the mounting shaft 210 is secured to the base 110 via the threaded base bolt 130, wherein the second end of the mounting shaft 210 is generally closed and comprises a threaded aperture 215 for receiving the threaded base bolt 130, wherein the second end of the mounting shaft 210 is screwed onto the threaded base bolt 130 to secure the shaft 210 to the base 110; and (e) a bottom bracket 310, wherein the bottom bracket 310 is a generally flat elongated panel having a first end 514 and a second end 516, wherein a bottom bracket length is measured from the first end 514 to the second end 516, wherein the bottom bracket further comprises a first bracket aperture 524 at the first end 514 and a second bracket aperture 526 at the second end 516, wherein an axis, Axis B 410, lies perpendicular to Axis A 400, wherein when the bottom bracket 310 lies parallel with Axis A 400 having the bottom bracket length parallel with the base length, the first bracket aperture 524 and the second bracket aperture 526 are aligned with the first base aperture 504 and second base aperture 506 of the base 110, respectively, wherein a distance between the first bracket aperture 524 and the second bracket aperture 526 is equal to the distance between the first base aperture 504 and second base aperture 506, wherein a first bolt 330 is inserted through the first base aperture 504 and the first bracket aperture 524, wherein a second bolt 330 is inserted through the second base aperture 506 and the second bracket aperture 526, wherein when the bottom bracket 310 lies parallel with Axis B 410 having the bottom bracket length parallel with the base width and perpendicular to the base length, the first bracket aperture 524 and the second bracket aperture 526 are disposed on either side of the third side edge 116 and the fourth side edge 118 having a clearance offset from the third side edge 116 and the fourth side edge 118 with respect to the base 110 edge, wherein a distance between an interior tangent of the first bracket aperture 524 and an interior tangent of the second bracket aperture 526 is greater than the base width, wherein a first bolt 330 is inserted through the first bracket aperture 524 so that the first bolt 330 does not contact the base 110 edge of the third side edge 116 or the fourth side edge 118, wherein a second bolt 330 is inserted through the second bracket aperture 526 so that the second bolt 330 does not contact the base 110 edge of the third side edge 116 or the fourth side edge 118, wherein when the bottom bracket 310 is positioned below the base 110 parallel with Axis A 400 with a surface of a fixture 512 sandwiched in between, a first bolt 330 is driven through the first base aperture 504 and the first bracket aperture 524, and a second bolt 330 is driven through the second base aperture 506 and the second bracket aperture 526, thereby clamping the edge of a surface of a fixture 512 therein between the bottom bracket 310 and the base 110, wherein when the bracket 310 is positioned above and interfacingly across the base top surface 500 parallel with Axis B 410 and longitudinally disposed perpendicular thereto on the surface of a fixture 512, the first bolt 330 is driven through the first bracket aperture 524 into a surface of the fixture 512 and the second bolt 330 is driven through the second bracket aperture 526 into a surface of the fixture 512, thereby affixing the base 110 via the bottom bracket 310 to the surface of the fixture 512.

2. The system of claim 1 further comprising a first cup holder 120*a* disposed on the top surface 500 of the base 110.

3. The system of claim 1 further comprising a second cup holder 120*b* disposed on the top surface 500 of the base 110.

4. The system of claim 1 wherein the mounting shaft 210 further comprises a tightening mechanism 220, which functions to clamp on the umbrella shaft when placed in the mounting shaft 210.

* * * * *